US006418911B1

(12) United States Patent
Augustin

(10) Patent No.: US 6,418,911 B1
(45) Date of Patent: Jul. 16, 2002

(54) DEVICE AND PROCEDURE FOR COUPLING A FLUID RAIL WITH FUEL INJECTORS

(75) Inventor: Ulrich Augustin, Blythewood, SC (US)

(73) Assignee: Siemens Diesel Systems Technology, Blythewood, SC (US)

( * ) Notice: Subject to any disclaimer, the term of this patent is extended or adjusted under 35 U.S.C. 154(b) by 0 days.

(21) Appl. No.: 09/903,688

(22) Filed: Jul. 13, 2001

(51) Int. Cl.[7] ..... F02M 37/04
(52) U.S. Cl. ..... 123/468; 123/456; 123/470
(58) Field of Search ..... 123/456, 468, 123/469, 470

(56) References Cited

U.S. PATENT DOCUMENTS

| | | | | |
|---|---|---|---|---|
| 1,321,154 A | | 11/1919 | Sager | |
| 2,173,743 A | | 9/1939 | Humason | 251/44 |
| 2,476,777 A | | 7/1949 | Smith | 158/27.4 |
| 2,529,821 A | | 11/1950 | Snider | 285/178 |
| 3,129,960 A | | 4/1964 | Schrodt | 285/95 |
| 3,695,642 A | | 10/1972 | DeWoody | 285/133 |
| 4,295,452 A | * | 10/1981 | Lembke et al. | 123/470 |
| 4,576,218 A | | 3/1986 | Artz et al. | 164/431 |
| 4,776,617 A | | 10/1988 | Sato | 285/165 |
| 5,033,435 A | * | 7/1991 | Ostarello et al. | 123/469 |
| 5,163,722 A | | 11/1992 | Worden | 285/375 |
| 5,365,907 A | | 11/1994 | Dietrich et al. | 123/470 |
| 5,394,850 A | * | 3/1995 | Murphy et al. | 123/470 |
| 5,499,612 A | * | 3/1996 | Haughney et al. | 123/470 |
| 5,771,863 A | * | 6/1998 | Daly | 123/456 |
| 5,823,446 A | | 10/1998 | Bennett et al. | 239/585.1 |
| 5,836,286 A | * | 11/1998 | Timmer | 123/470 |
| 5,983,864 A | | 11/1999 | Chockley et al. | 123/470 |
| 6,056,329 A | | 5/2000 | Kitani et al. | 285/145.3 |
| 6,102,007 A | * | 8/2000 | Furst | 123/469 |
| 6,148,797 A | * | 11/2000 | Gmelin | 123/456 |

* cited by examiner

*Primary Examiner*—Thomas N. Moulis
(74) *Attorney, Agent, or Firm*—McGuireWoods LLP

(57) ABSTRACT

A connector for communicating fluid between a fluid rail and a fuel injector. The connector comprises a tubular member extending along a longitudinal axis between a first end and a second end, a first member adapted to form a seal between the tubular member and the fluid rail, and a second member adapted to form a seal between the tubular member and the fuel injector. The tubular member includes an interior surface and an exterior surface, and further includes first and second projections from the exterior surface. The first projection defines a first shoulder and the second projection defines a second shoulder. The first projection is adapted to be received within the fluid rail and the second projection is adapted to be received within the fuel injector. The tubular member is adapted for axial displacement relative to at least one of the hydraulic fluid rail and the fuel injector. The first member contiguously engages the first shoulder, and the second member contiguously engages the second shoulder.

18 Claims, 3 Drawing Sheets

DEVICE AND PROCEDURE FOR COUPLING A FLUID RAIL WITH FUEL INJECTORS

FIELD OF THE INVENTION

This invention is directed to a device and a method for connecting a plurality of fuel injectors to at fluid rail.

BACKGROUND OF THE INVENTION

It is believed that high-pressure fuel injectors use hydraulic fluid that is pressurized to about 3000 p.s.i. (20.7 MPa) to inject fuel, which is pressurized to around 60 p.s.i. (0.414 MPa), into an engine. The pressurized hydraulic fluid is supplied to the injectors by what is believed to be known as a "jumper tube," which extends between a hydraulic fluid rail and each of the injectors. It is believed that the injectors are directly mounted to the cylinder head.

It is believed that cylinder heads of an engine may move 1 to 2 mm with respect to the fluid rail. This movement is believed to be due to temperature changes and large built-in tolerances of the engine. Because of this movement, it is believed that leakage and vibration-induced cracks can develop in the jumper tubes or the fluid rail.

Thus, it is believed that there is a need to overcome these and other problems associated with fuel injector jumper tubes.

SUMMARY OF THE INVENTION

Accordingly, the present invention is provided by a connector for communicating fluid between a fluid rail and a fuel injector. The connector comprises a tubular member extending along a longitudinal axis between a first end and a second end. a first member adapted to form a seal between the tubular member and the fluid rail. and a second member adapted to form a seal between the tubular member and the fuel injector. The tubular member includes an interior surface and an exterior surface, and further includes first and second projections from the exterior surface. The first projection defines a first shoulder and the second projection defines a second shoulder. The first projection is adapted to be received within the fluid rail and the second projection is adapted to be received within the fuel injector. The tubular member is adapted for axial displacement relative to at least one of the hydraulic fluid rail and the fuel injector. The first member contiguously engages the first shoulder, and the second member contiguously engages the second shoulder.

The present invention is also provided by a fuel injection system. The system comprises a fluid rail that has a first port, a fuel injector that has a second port, a tubular member, a first member sealing the tubular member and the fluid rail, and a second member sealing the tubular member and the fuel injector. The fuel injector is in fluid communication with the fluid rail. The tubular member extends along a longitudinal axis between a first end and a second end. The tubular member includes an interior surface and an exterior surface, and further includes first and second projections from the exterior surface. The first projection defines a first shoulder and the second projection defines a second shoulder. The first projection is received within the fluid rail and the second projection is received within the fuel injector. The tubular member is axially displaceable relative to at least one of the hydraulic fluid rail and the fuel injector. The first member contiguously engages the first shoulder, and the second member contiguously engages the second shoulder.

The present invention is further provided by a method of providing a pressurized fluid. The method comprises providing a fluid rail adapted to supply the pressurized fluid, providing a fuel injector adapted to be operated by the pressurized fluid, providing a tubular member. providing a first seal, providing a second seal, and permitting the tubular member to move at least one of axially and angularly relative to at least one of the fluid rail and the fuel injector. The fluid rail has a first port adapted to dispense the pressurized fluid. The fuel injector has a first port adapted to receive the pressurized fluid. The tubular member extends along a longitudinal axis between a first end and a second end. The tubular member includes an interior surface and an exterior surface. and further includes first and second projections from the exterior surface. The first projection defines a first shoulder and the second projection defines a second shoulder. The first projection is received within the fluid rail and the second projection is received within the fuel injector. The first seal is provided between the tubular member and the first port. and the second seal is provided between the tubular member and the second port.

BRIEF DESCRIPTION OF THE DRAWINGS

The accompanying drawings, which are incorporated herein and constitute part of this specification, illustrate presently preferred embodiments of the invention, and, together with the general description given above and the detailed description given below, serve to explain features of the invention.

DETAILED DESCRIPTION OF THE PREFERRED EMBODIMENT

Figure 1:
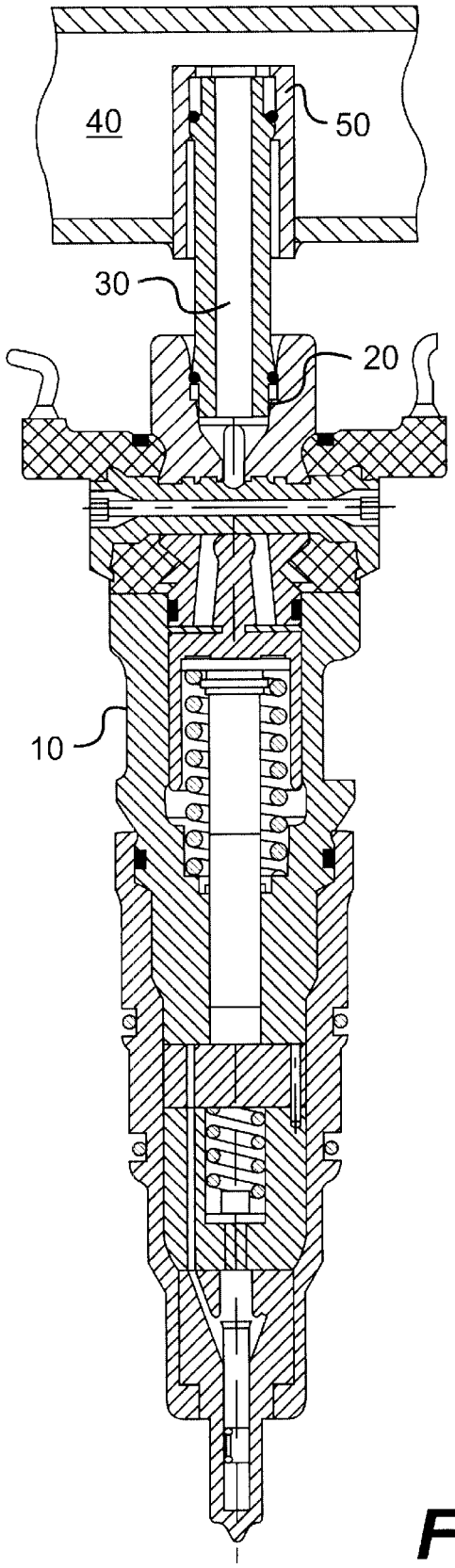
FIG. 1 is a cross-sectional view of a connection according to a first embodiment between a fluid rail and an injector.

Referring to FIG. 1, a high-pressure fuel injector 10 is connected to a fluid rail 40. For the sake of illustration simplicity, only one injector 10 is shown. Of course, more than one injector 10 can be mounted on an engine cylinder head (not shown) and connected to the fluid rail 40. The injector 10 has an inlet port 20 and the fluid rail 40 has an outlet port 50. The fluid rail 40 is connected to the injector 10 inlet port 20 by a connector tube 30 that provides fluid communication between the rail 40 and the injector 10.

Figure 2:
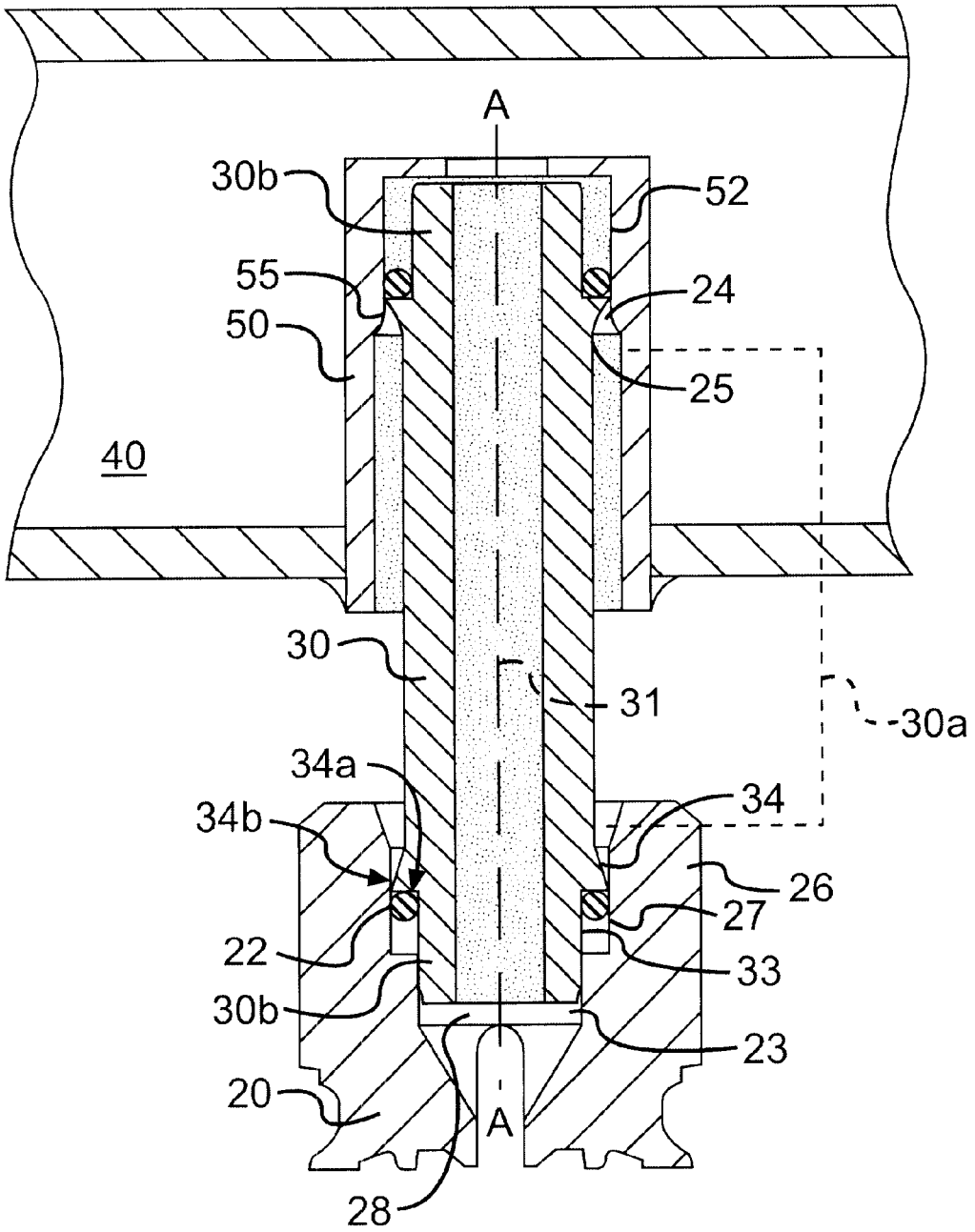
FIG. 2 shows an enlarged cross-sectional view of the connection shown in FIG. 1.

Referring also to FIG. 2, the connector tube 30, which extends along an axis A—A, is hollow to allow a fluid 31 to communicate between the outlet port 50 and the injector inlet port 20. Preferably, the fluid 31 can be a substantially incompressible hydraulic fluid. An exterior surface of the connector tube 30 includes projections 34 at each end. The projections 34 define a shoulder 34*a* that extends substantially transversely with respect to the axis A—A to a peak 34*b*. The diameter of the peaks 34*b* are slightly smaller than the respective inlet port 20 and outlet port 50. According to a first embodiment, the projections taper inwardly toward one another such that the projections 34 have a generally triangular cross-section. An axial intermediate portion 30*a*, i.e., between the projections 34, of the connector tube 30 can have a greater wall thickness than the axial end portions 30*b* of the connector tube 30.

Disposed around the connector tube 30 and abutting each of the shoulders 34*a* is a respective O-rings 22. One or both of the O-rings 22 can also be disposed in an annular groove (not shown) formed in the axial end portion 30*b* of the connector tube 30.

The inlet port 20 and the outlet port 50 can have respective conical portions 25 and 55 to facilitate assembly of the connector tube 30 with the injector 10 and the fluid rail 40. The outer diameters of the axial end portions 34*b* are smaller than the inner diameters of the inlet port 20 and the outlet port 50 in order to allow canting of the connector tube 30 with respect to the injector 10 and the fluid rail 40. That is to say, if the central axes of the inlet port 20 and the outlet port 50, which are ideally aligned collinearly, become laterally displaced with respect to one another, the canting of the connector tube 30 accommodates this misalignment. The relative difference in the diameters and the length of the axial end portions 34*b* determine the amount of misalignment that the connector tube 30 can accommodate.

The axial length of the connector tube 30 is less than the distance between the bottoms of the inlet port 20 and the outlet port 50. This relative difference enables the connector tube 30 to be displaced axially with respect to the inlet port 20 and the outlet port 50. The axial position of the connector tube 30 with respect to the injector 10 and the fluid rail 40 can be fixed if the diameters of the inlet port 20 and the outlet port 50 are substantially equal. That is to say, there will be a pressure balance that tends to maintain the axial position of the connector tube 30 if the portions of the inlet port 20 and the outlet port 50 that receive the projections 34 and the O-rings 22 have the same inner diameters.

Thus, the connector tube 30 is floatingly mounted with respect to both the fluid rail 40 and injector 10 by virtue of the features that allow the connector tube 30 to move axially and angularly within the inlet port 20 and the outlet port 50, and by virtue of the features that establish a pressure balance.

During engine assembly, the injector 10 is fixed to the engine cylinder head (not shown) and a first end of the connector tube 30 is telescopically inserted into inlet port 20 of the injector 10. Of course, if there are multiple injectors, e.g., for a multi-cylinder engine, each injector receives a respective connector tube 30. Next, the outlet port 50 of the fluid rail 40 telescopically receives a second end of the connector tube 30 and the fluid rail 40 is mounted with respect to the engine. As discussed above, the fluid rail 40 is mounted at a distance from the injector 10 that is slightly greater than the axial length of the connector tube 30 in order to allow some axial displacement of the connector tube with respect to the injector 10 and the fluid rail 40.

Figure 3:
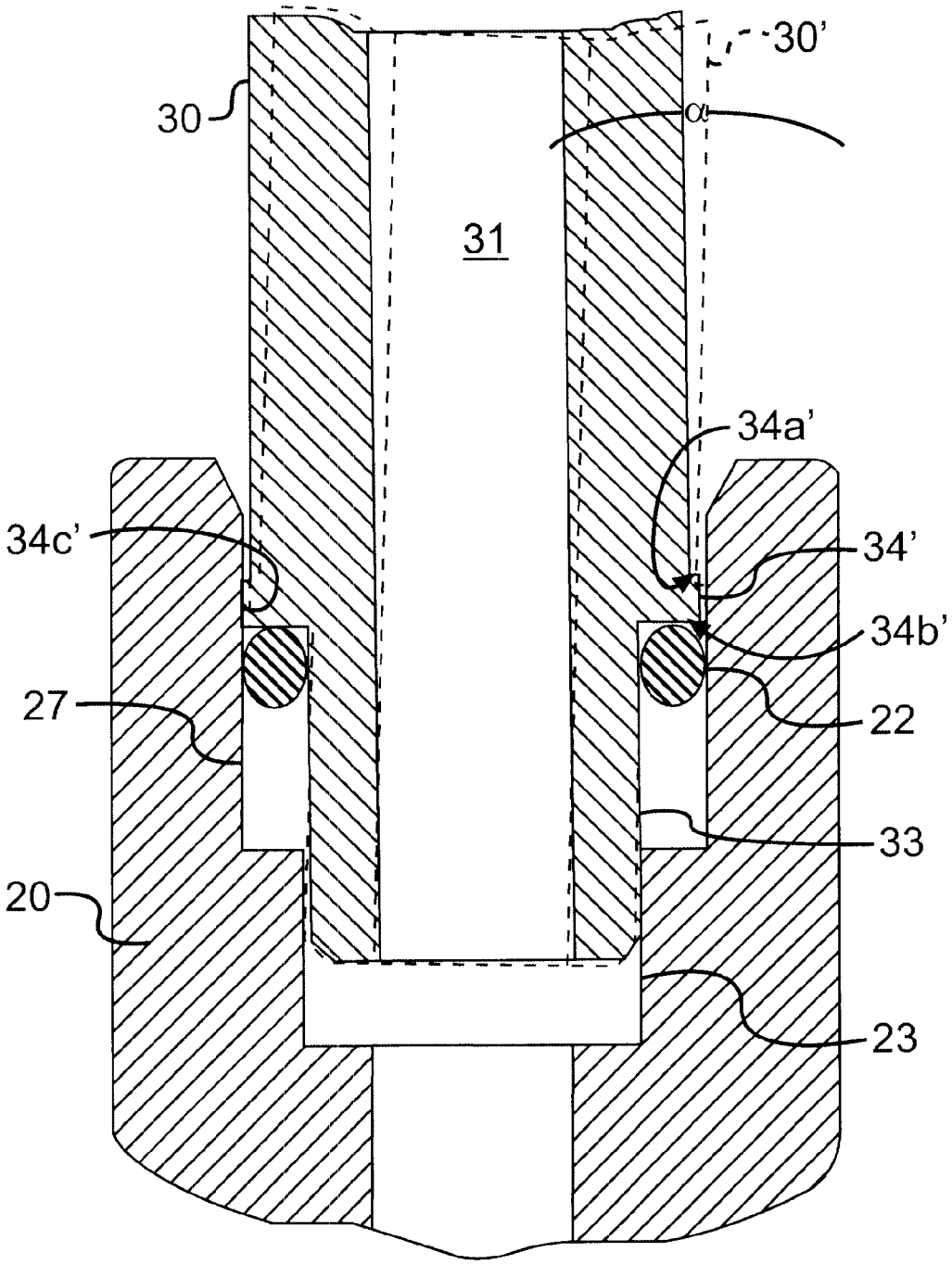
FIG. 3 shows an enlarged cross-sectional view of a connection according to a second embodiment to an injector.

Referring now to FIG. 3, a connector tube 30' has a projection 34' that includes a face 34*c*' extending generally parallel to the axis A—A from a peak 34*b*' of a shoulder 34*a*'. Thus, according to a second embodiment, the projection 34' has a generally rectangular cross-section. Of course, another projection having the same or a different cross-section shape, e.g., the triangular cross-section, is located at the opposite end of the connector tube 30'. According to this second embodiment, the angular misalignment a that the connector tube 30' accommodate can be made to depend on the outer diameter of the projection 34' relative to the inner diameter of the inlet port 20 and the axial length of the face 34*c*'. In general, the angular misalignment that can be accommodated ranges up to 10°, and is preferably at least 2°. The other features and functions of the projection 34' can be similar to those of the projection 34 as described above.

Several advantages are believed to be achieved. including providing a reliable connector tube that accommodates angular and axial deviations that can arise due to manufacturing tolerances and varying operating conditions, a connector tube that is pressure balanced with respect to an injector and a fluid rail, and that facilitates engine assembly without any special tools.

While the claimed invention has been disclosed with reference to certain preferred embodiments, numerous modifications, alterations, and changes to the described embodiments are possible without departing from the sphere and scope of the claimed invention. as defined in the appended claims. Accordingly, it is intended that the claimed invention not be limited to the described embodiments, but that it have the full scope defined by the language of the following claims, and equivalents thereof.

What is claimed is:

1. A connector for communicating fluid between a fluid rail and a fuel injector, the connector comprising:

a tubular member extending along a longitudinal axis between a first end and a second end, and including an interior surface and an exterior surface, the tubular member further including first and second projections from the exterior surface, the first projection defining a first shoulder and the second projection defining a second shoulder, the first projection being adapted to be received within the fluid rail and the second projection is adapted to be received within the fuel injector, and the tubular member being adapted for axial displacement relative to at least one of the hydraulic fluid rail and the fuel injector;

a first member adapted to form a seal between the tubular member and the fluid rail, the first member contiguously engaging the first shoulder; and a second member adapted to form a seal between the tubular member and the fuel injector, the second member contiguously engaging the second shoulder.

2. The connector as claimed in claim 1, wherein at least one of the first and second members comprises an O-ring.

3. The connector as claimed in claim 2, wherein the first and second members each comprise an O-ring.

4. The connector as claimed in claim 3, wherein at least one of the first and second projections comprises a generally triangular cross-section shape.

5. The connector as claimed in claim 1 wherein at least one of the first and second projections comprises a generally rectangular cross-section shape.

6. The connector as claimed in claim 1, wherein the tubular member is adapted for canting relative to at least one of the fluid rail and fuel injector.

7. A fuel injection system, the system comprising:

a fluid rail having a first port;

a fuel injector in fluid communication with the fluid rail, the fuel injector having a second port;

a tubular member extending along a longitudinal axis between a first end and a second end, and including an interior surface and an exterior surface, the tubular member further including first and second projections from the exterior surface, the first projection defining a first shoulder and the second projection defining a second shoulder, the first projection being received within the fluid rail and the second projection being received within the fuel injector, and the tubular member being axially displaceable relative to at least one of the hydraulic fluid rail and the fuel injector;

a first member sealing the tubular member and the fluid rail, the first member contiguously engaging the first shoulder; and a second member sealing the tubular member and the fuel injector, the second member contiguously engaging the second shoulder.

8. The fuel injection system as claimed in claim 7, wherein at least one of the first and second members comprises an O-ring.

9. The fuel injection system as claimed in claim 7, wherein the first and second members each comprise an O-ring.

10. The connector as claimed in claim 9, wherein at least one of the first and second projections comprises a generally triangular cross-section shape.

11. The connector as claimed in claim 9, wherein at least one of the first and second projections comprises a generally rectangular cross-section shape.

12. The connector as claimed in claim 9, wherein the tubular member is adapted for canting relative to at least one of the fluid rail and fuel injector.

13. The connector as claimed in claim 9, wherein a first diameter of the first port is substantially equal to a second diameter of the second port.

14. A method of providing a pressurized fluid, the method comprising:

providing a fluid rail adapted to supply the pressurized fluid, the fluid rail having a first port adapted to dispense the pressurized fluid;

providing a fuel injector adapted to be operated by the pressurized fluid, the fuel injector having a first port adapted to receive the pressurized fluid;

providing a tubular member extending along a longitudinal axis between a first end and a second end, and including an interior surface and an exterior surface, the tubular member further including first and second projections from the exterior surface, the first projection defining a first shoulder and the second projection defining a second shoulder, the first projection being received within the fluid rail and the second projection being received within the fuel injector;

providing a first seal between the tubular member and the first port;

providing a second seal between the tubular member and the second port; and permitting the tubular member to move at least one of axially and angularly relative to at least one of the fluid rail and the fuel injector.

15. The method as claimed in claim 14, wherein the providing the first seal comprises providing a first O-ring contiguously engaging the first shoulder, and the providing the second seal comprises providing a second O-ring contiguously engaging the second shoulder.

16. The method as claimed in claim 14, wherein the providing the tubular member comprises forming at least one of the first and second projections with a generally triangular cross-section shape.

17. The method as claimed in claim 16, wherein the providing the tubular member comprises forming at least one of the first and second projections with a generally rectangular cross-section shape.

18. The method as claimed in claim 16, wherein the permitting the tubular member to move comprises pressure balancing the tubular member with respect to the first and second ports.

* * * * *